US009498672B1

(12) United States Patent
Miller

(10) Patent No.: US 9,498,672 B1
(45) Date of Patent: Nov. 22, 2016

(54) ELLIPTICAL EXERCISE DEVICE WITH MOVING CONTROL TRACKS

(71) Applicant: Larry D. Miller, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 15/042,769

(22) Filed: Feb. 12, 2016

Related U.S. Application Data

(60) Provisional application No. 62/258,768, filed on Nov. 23, 2015.

(51) Int. Cl.
*A63B 22/04* (2006.01)
*A63B 23/04* (2006.01)
*A63B 23/035* (2006.01)

(52) U.S. Cl.
CPC ..... *A63B 22/04* (2013.01); *A63B 23/03525* (2013.01); *A63B 23/04* (2013.01)

(58) Field of Classification Search
USPC ..... 482/51–52, 57, 62
See application file for complete search history.

(56) References Cited

U.S. PATENT DOCUMENTS 5,792,029 A 8/1998 Gordon
5,957,814 A * 9/1999 Eschenbach ..... A63B 22/001 482/51
6,135,926 A 10/2000 Lee
6,146,314 A 11/2000 Lee
6,152,859 A 11/2000 Stearns
6,168,552 B1 * 1/2001 Eschenbach ..... A63B 22/001 482/51
6,196,948 B1 3/2001 Stearns et al.
6,361,476 B1 3/2002 Eschenbach
6,422,976 B1 * 7/2002 Eschenbach ..... A63B 22/001 482/51
6,422,977 B1 * 7/2002 Eschenbach ..... A63B 22/001 482/51
6,440,042 B2 * 8/2002 Eschenbach ..... A63B 22/001 482/51
6,482,132 B2 11/2002 Eschenbach
6,726,600 B2 4/2004 Miller
7,014,597 B2 3/2006 Tsai
7,060,005 B2 * 6/2006 Carlsen ..... A63B 22/001 482/52
7,104,929 B1 9/2006 Eschenbach
7,121,984 B1 10/2006 Hong
7,172,531 B2 * 2/2007 Rodgers, Jr. ..... A63B 22/001 482/52
7,201,704 B2 * 4/2007 Stearns ..... A63B 22/001 482/52
7,201,705 B2 * 4/2007 Rodgers, Jr. ..... A63B 22/001 482/52
7,214,168 B2 * 5/2007 Rodgers, Jr. ..... A63B 22/001 482/52
7,223,209 B2 * 5/2007 Lee ..... A63B 22/001 482/52
7,377,881 B2 5/2008 Moon
7,455,624 B2 * 11/2008 Liao Lai ..... A63B 22/001 482/51
7,556,591 B2 * 7/2009 Chuang ..... A63B 22/001 482/51
7,854,469 B2 12/2010 Dayton
7,874,963 B2 1/2011 Grind
7,922,625 B2 4/2011 Grind
8,133,159 B2 * 3/2012 Eschenbach ..... A63B 21/00069 482/52

(Continued)

*Primary Examiner* — Stephen Crow
(74) *Attorney, Agent, or Firm* — Dinsmore & Shohl LLP; Douglas L. Wathen

(57) ABSTRACT

An elliptical exercise device has a frame and guide link pivotally attached thereto. A foot support link is pivotally connected to a lower attachment point of each guide link so that when the guide links pivot relative to the frame, foot receiving areas of the foot support links move in a path of travel having a horizontal component of motion. Vertical control tracks are pivotally connected to the frame and support the foot support links. A vertical drive is coupled to the forward portion of the frame and vertical control elements connect the vertical drive to the vertical control tracks. A horizontal drive and horizontal control links control pivoting of the guide links.

21 Claims, 7 Drawing Sheets

(56) References Cited

U.S. PATENT DOCUMENTS 8,556,779 B2 * 10/2013 Grind ..... A63B 21/154 482/51
8,628,454 B2 1/2014 Wu
8,668,627 B2 * 3/2014 Eschenbach ..... A63B 21/00069 482/51
8,740,754 B2 * 6/2014 Miller ..... A63B 22/001 482/51
2004/0043871 A1 * 3/2004 Chang ..... A63B 22/001 482/52
2005/0101446 A1 5/2005 Stearns et al.
2007/0298936 A1 12/2007 Ohrt et al.
2008/0318735 A1 12/2008 Smith
2010/0167877 A1 7/2010 Grind
2012/0277066 A1 * 11/2012 Hsu ..... A63B 22/001 482/57

* cited by examiner

ELLIPTICAL EXERCISE DEVICE WITH MOVING CONTROL TRACKS

CROSS REFERENCE TO RELATED APPLICATION

This application claims priority from U.S. provisional patent application Ser. No. 62/258,768, filed Nov. 23, 2015, the contents of which are incorporated herein in their entirety.

FIELD OF THE INVENTION

This invention relates to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links are pivotally supported on a frame and a foot engaging link is supported at the lower end of each guide link. An intermediate link connects each guide link to crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

SUMMARY OF THE INVENTION

The present invention offers several embodiments of an elliptical exercise device. Some embodiments offer a path of motion with desirable characteristics. In addition, some embodiments are compact in form and have reduced mechanical complexity.

A first embodiment of an elliptical exercise device includes a frame configured to be supported on a horizontal surface. The frame has a first pivot axis and a second pivot axis defined thereon, a forward portion forward of the first pivot axis and a rearward portion rearward of the first pivot axis. The second pivot axis is on the forward portion of the frame. A first and a second vertical control track each have a track surface, a forward end pivotally connected to the second pivot axis of the frame and a coupling point defined rearward of the second pivot axis. A first and a second guide link each have a first and a second attachment point defined thereon. Each guide link is pivotally attached, through its first attachment point, to the frame at the first pivot axis thereof. A first and a second foot support link each have a foot receiving area configured to support a user's foot thereupon. Each foot support link is pivotally connected to the second attachment point of a respective one of the guide links so that when the guide links pivot relative to the frame, they each cause the respective foot receiving area to move in a path of travel having a horizontal component of motion. Each foot support link engages the track surface of a respective one of the vertical control tracks and is vertically supported thereby. A vertical drive is coupled to the forward portion of the frame. A first and a second vertical control element each have an upper end coupled to the vertical drive and a lower end coupled to the coupling point of the respective foot support link such that the vertical drive causes the vertical control tracks to pivot with respect to the frame and the foot receiving area of the respective foot support link to move in a path having a vertical component of motion. The exercise device also has a horizontal drive. A first and a second horizontal control link each have a first end connected to the horizontal drive and a second end connected to a respective one of the guide links such that the horizontal drive the guide links to pivot about the first pivot axis, thereby moving the foot receiving areas of the foot support links in a path of travel having a horizontal component of motion. Movement of each foot receiving area in the path of travel having a horizontal component of motion is generally out of phase with the movement in the path of travel having a vertical component of motion such that when the horizontal component of motion of each foot receiving area is at its forwardmost or rearwardmost limit, the vertical component of motion of the same foot receiving area is approximately midway between its uppermost and lowermost limit. As such, the foot receiving area of each foot support link moves in a generally elliptical path.

In some versions, the vertical drive and the horizontal drive together are a crank, the crank having a first and a second attachment point spaced from the crank axis, the upper ends of the vertical control elements being connected to a respective one of the attachment points. In other versions, the vertical drive is a cam drive having a first and second cam supported for rotation about an axis of rotation and a first and a second pivoting arm engaging the respective first and second cams such that rotation of the cams causes movement of the pivoting arms. The upper ends of the vertical control elements are connected to a respective one of the pivoting arms. Each pivoting arm may have a cam follower that engages the respective cam. The horizontal drive may be a crank and the cam drive and the crank may be supported for rotation about the same axis of rotation or may be separate.

In some versions, the track surface of each vertical control track is an upper surface of the vertical control track.

In certain versions, each foot support link is a rigid member and the foot receiving area is fixed with respect to a remainder of each respective foot support link. Each foot support link may have a forward end that is pivoted to the second attachment point of the respective guide link and a rearward end defining the foot receiving area. Each foot support link may have a roller that engages the track surface. Each roller may be disposed on a rearward portion of the respective foot support link with the foot receiving area defined behind the respective roller.

In some versions, each vertical control track is supported only by the respective pivotal connection to the second pivot axis of the frame and the respective vertical control element.

In certain versions, the forward end of each vertical control track further has a connection portion extending reawardly from the pivotal connection and above an upper surface of the track, the lower end of each vertical control element being connected to a rear end of the connection portion of the respective vertical control track.

In some versions, the track surface of each vertical control track is concave.

The vertical control elements may be flexible elements or rigid links.

In some versions, each guide link further has a hand grip that extends upwardly from the respective first attachment point.

In certain versions, the horizontal control links are each adjustably connected to the crank or the respective guide link so as to adjust the range of horizontal motion.

Some versions include a flywheel and resistance assembly coupled to the vertical drive and/or crank.

In some versions, the upper end of each vertical control elements is coupled to the vertical drive by being connected to the respective one of the horizontal control links. The connection between the upper end of each vertical control element and the respective horizontal control link may adjustable so as to adjust a range of vertical travel.

As will be clear to those of skill in the art, the various elements, details and variations illustrated and discussed with respect to particular embodiments may be combined in different ways and used with other embodiments, in any combination.

DETAILED DESCRIPTION OF THE PREFERRED EMBODIMENTS

Figure 1:
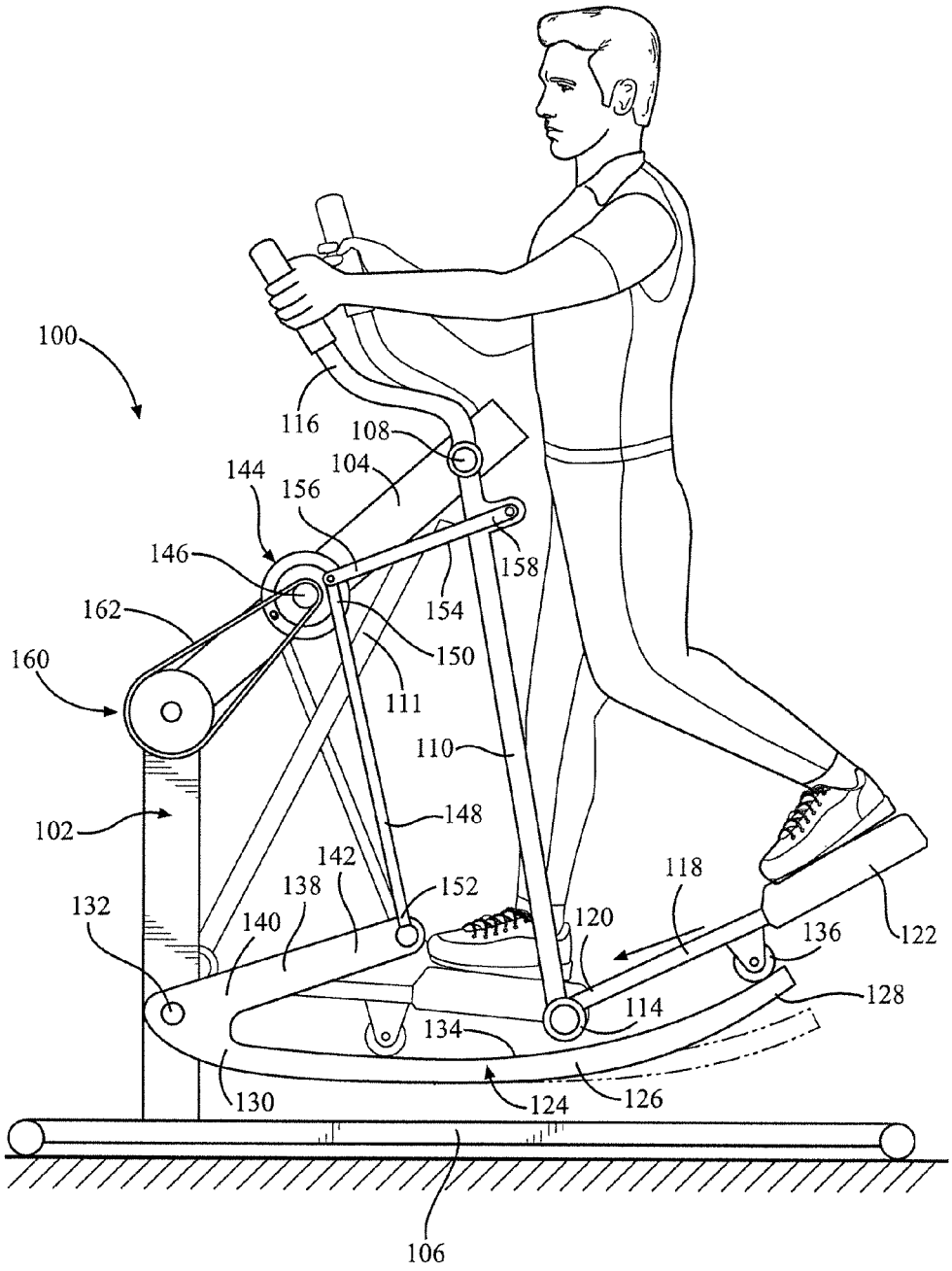
FIG. 1 is a side elevational view of an embodiment of an elliptical exercise device in accordance with the present invention.

The present invention will be explained with reference to several particular embodiments, including variations and optional features of these embodiments. It is to be understood that yet other embodiments, modifications, and variations thereof will be apparent to those of skill in the art in view of the teaching presented herein. Further, features and elements of certain embodiments may be combined with each other in combinations other than those illustrated, and variations and optional features may be used with any of the embodiments.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Embodiments of the present invention have left and right vertical control tracks that are pivotally attached to the frame of the exercise device and foot support links that are supported by these tracks. Left and right guide links are pivotally attached to the frame, typically to an upper part of the frame and have a lower end pivotally interconnected with one of the foot support links. Reciprocal motion of the guide links causes the foot support links to move along a path having a horizontal component of motion (i.e. fore and aft). The left and right vertical control tracks are coupled to a vertical drive such that the vertical drive pivots the vertical control tracks, thereby causing the respective foot support links to reciprocate along a path having a vertical component of motion (i.e. upwardly and downwardly). In free stride versions, the motion of the guide links may be coordinated by a horizontal coordination linkage, such the left and right guide links move in equally in opposite directions, and the guide links are not coupled to the crank system. In fixed path versions, the guide links may be coupled to a crank system, which may be the same vertical drive that is coupled to the vertical control tracks. The coupling of the control tracks and/or guide links to the drive or crank system or systems may be adjustable so as to adjust the amount of vertical and/or horizontal motion, and this adjustment may be manual or powered, and may be coordinated such that as horizontal motion is increased or decreased, vertical motion is increased or decreased, or vice versa. As will be clear to those of skill in the art, any of the embodiments described herein may be converted between free stride and fixed path by adding or removing links or couplings.

Figure 2:
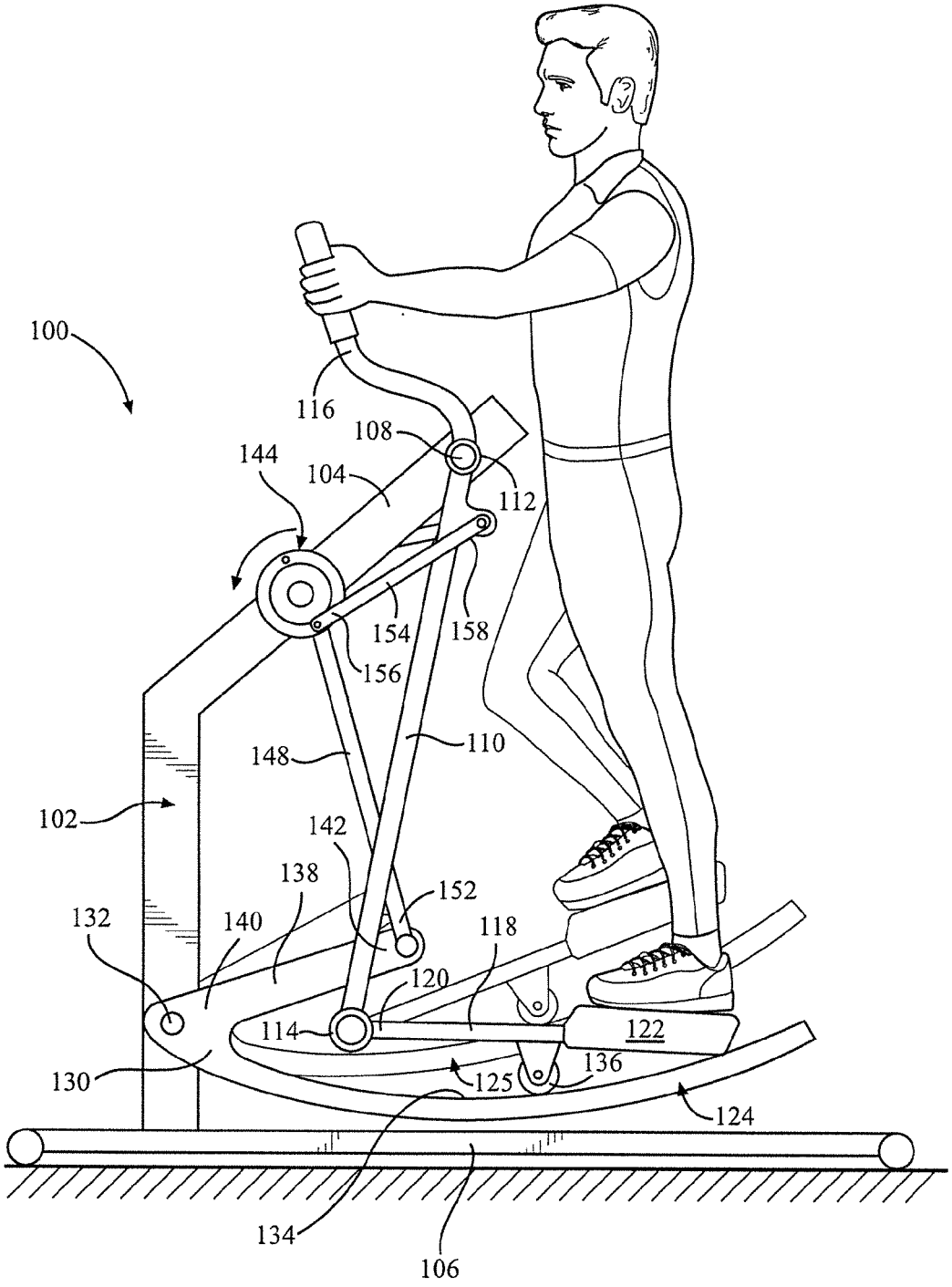
FIG. 2 is a side elevation view of the device of FIG. 1 with the guide links in a different position.
Figure 3:
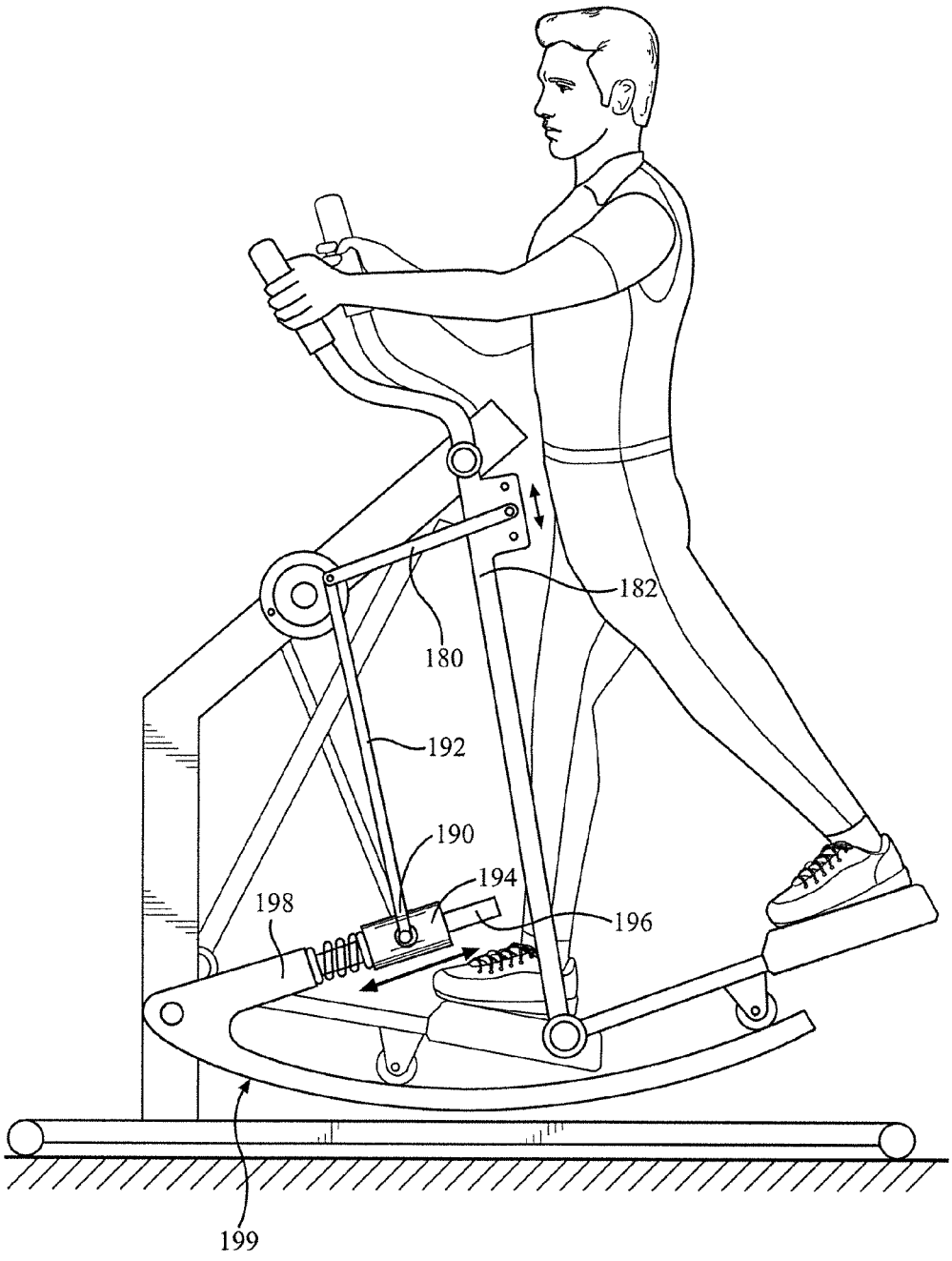
FIG. 3 is a side elevational view of an alternative version of an elliptical exercise device with adjustment mechanisms for adjusting horizontal and vertical travel.

Referring now to the Figures, FIGS. 1-3 show fixed path versions of an elliptical exercise device in accordance with the present invention and FIG. 4 shows a free stride version an elliptical exercise device in accordance with the present invention. Further versions, features, and Figures will be discussed below.

FIGS. 1 and 2 show the basic layout of a fixed path version of an elliptical exercise device 100, in which the horizontal motion is controlled by the exercise device. However, the device 100 may be modified to exclude a horizontal control system in order to convert the device into a free stride device. Various components are not shown in some of the views, to simplify the drawings. FIG. 1 shows the exercise device 100 with the foot receiving areas in the forwardmost and rearwardmost positions, while FIG. 2 shows foot receiving areas at the midpoint of the fore-aft travel.

The illustrated device 100 includes a frame 102 which is configured and operative to retain and support the various other components of the device on a horizontal surface such as a floor. The frame 102 is typically fabricated from metal and/or composite materials, but any material may be used. The frame 102 has an upper portion 104 and a lower portion 106. The lower portion 106 is configured to contact the horizontal surface while the upper portion 104 supports several components of the device. A first pivot axis 108 is defined in the upper portion 104 of the frame 102. The frame 102 may be said to have a forward portion forward of the first pivot axis 108, which is to the left in the view of FIGS. 1 and 2, and a rearward portion rearward of the first pivot axis 108, which is to the right in the view of FIGS. 1 and 2.

As will be clear to those of skill in the art, exercise devices such as those described herein include left and right elements for supporting the respective left and right feet of the user. The right and left components of the device are typically substantially the same, though the machine may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIGS. 1 and 2 show a side view of the device 100 with the left elements most visible. FIG. 2 is similar to FIG. 1 but with the crank system rotated 90 degrees.

A pair of guide links are pivotally interconnected with the frame so as to be pivotal about the first pivot axis 108. In FIG. 1, the left guide link 110 is shown at the rear of its travel and the right guide link 111 is at the front of its travel. In FIG. 2, the left guide link 110 is shown at the midpoint of its travel with the right guide link hidden behind it. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from the first attachment point 112. Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end. As shown, the foot support link 118 is a rigid member and the foot receiving area is integral therewith; the foot receiving area does not pivot or otherwise move relative to the remainder of the foot support link.

Referring to FIGS. 1 and 2, left and right vertical control tracks 124 and 125 are pivotally connected to the frame 102. The left control track 124 has a curved track portion 126 with a rearward end 128 and a forward end 130. The forward end 130 is pivotally connected to a second pivot axis 132 defined on the frame 102, on the forward portion of the frame, near to or on the lower portion 106. This second pivot axis is fixed with respect to the frame. The control track 124 has a concave upper surface 134. The left foot support link 118 has a roller 136 extending from an underside of a midportion of the foot support link 118. This roller 136 rolls along the upper surface 134 of the control track 124 such that the position of the control track controls the vertical position of the foot support link, and thereby the foot receiving area 122. As shown, the roller is connected to the rearward half of the foot support link, which is defined as the rearward portion of the foot support link. The foot receiving area 122 is behind the roller 136. Other configurations are possible. The foot support link 118 may interface with the track 124 in other ways, such as having a slider or wheel in place of the roller, in this or any other embodiment. Also, the track may have a track surface that is not the upper surface. The track 124 is shown with a concave upper surface. Alternatively, the surface may have a different curavature or shape, as shown in broken lines in FIG. 1, or may be straight. In certain versions, the rear portion of the track surface is curved upwardly more than the remainder to provide an additional lift at the rear of travel of the foot receiving areas. The track shape shown in solid lines in FIG. 1 has additional curvature towards the rearward end.

The left vertical control track 124 further has a connection portion 138 with a forward end 140 joined to the forward end 130 of the curved track portion 126 and a rearward end 142 extending rearwardly and above the track portion 126.

A crank system 144 is pivotally interconnected with the forward portion of the frame 102 at and rotatable about a third pivot axis 146. The crank system 144 is disposed above the second pivot axis 132. A left vertical control link 148 has an upper end 150 coupled to an attachment point on the crank system 144 and a lower end 152 coupled to the rearward end 142 of the connection portion 138 of the left vertical control track. As such, the vertical control link is connected to the vertical control track rearward of the second pivot axis 132. As shown, the vertical control link 148 is coupled to the crank system 144 at an attachment point offset from the third pivot axis 146 such that rotation of the crank system 144 causes the vertical control link 148 to reciprocate. This reciprocation causes the vertical control track 124 to pivot upwardly and downwardly about the second pivot axis 132, thereby causing the foot support link 118 to pivot about its forward end and the foot receiving area 122 to move along a path having a vertical component of motion.

As shown in the Figures, the vertical control track 124 is supported solely by the pivot at 132 and the vertical control link 148. It does not contact the ground or the frame in other ways. The foot support link is supported solely by the pivot to the guide link at 114 and the vertical control track 124.

Because the embodiment of FIGS. 1 and 2 is a fixed path elliptical exercise device, horizontal control is also provided. A left horizontal control link 154 has a forward end 156 coupled to the crank system 144 and a rearward end 158 coupled to the left guide link 110 at a position below the first attachment point 112. In this version, the forward end 156 of the horizontal control link 154 is coupled to the same position on the crank system as the upper end 150 of the vertical control link. In alternative versions, the coupling points may be radially and/or rotationally offset from each other. Rotation of the crank system 144 causes the guide links 110 and 111 to pivot about their first attachment points, which causes the foot support links, and the foot receiving areas, to move along a path having a horizontal component of motion.

FIG. 1 also shows a flywheel and resistance assembly 160 that in interconnected with the crank system 144 by a belt 162. The flywheel and resistance assembly may be integrated or a separate flywheel assembly and resistance assembly may be provided, and either may be connected to the moving components in a variety of ways other than shown. The flywheel and resistance assembly is left out of most of the Figures for simplicity.

FIG. 3 is similar to FIGS. 1 and 2, but shows two approaches to providing adjustment. In the first approach, the attachment between the horizontal control link 180 and the respective guide link 182 may be adjusted, manually, between multiple connection points, thereby altering the amount of travel along the path having a horizontal component of motion. In the second approach, the lower end 190 of the vertical control link 192 is coupled to a slider 194 that is slidable along the rearward end 196 of the connection portion 198 of the respective vertical control track 199. A spring may bias the slider rearwardly, and an adjustment mechanism, not shown, may be provided for manual or power adjustment of the slider position, such as via a cable pulling the slider forwardly against the spring. Altering the position of the slider changes the motion of the track 199, and therefore the foot support link and foot receiving area, along a path having a vertical component of motion. A slider may be used in place of the connection points on the guide link 182 or vice versa. Other approaches may also be used for adjusting vertical or horizontal travel. The vertical and horizontal adjustment may be coordinated by computer or other means so that as one is increased, the other is increased or decreased, depending on the design, and vice versa.

Figure 4B:
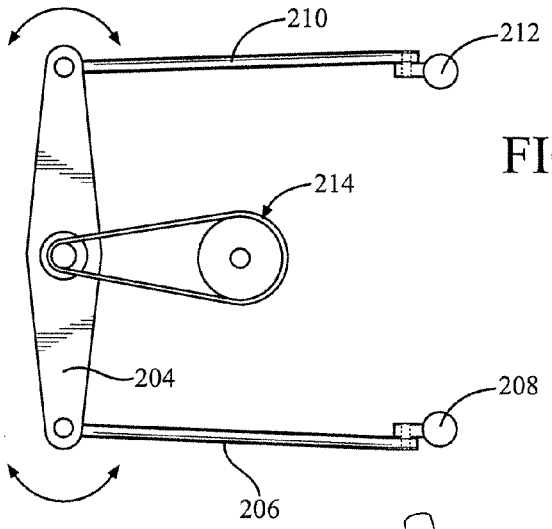
FIG. 4B is a top view of the horizontal coordination linkage for the exercise device of FIG. 4A.
Figure 4A:
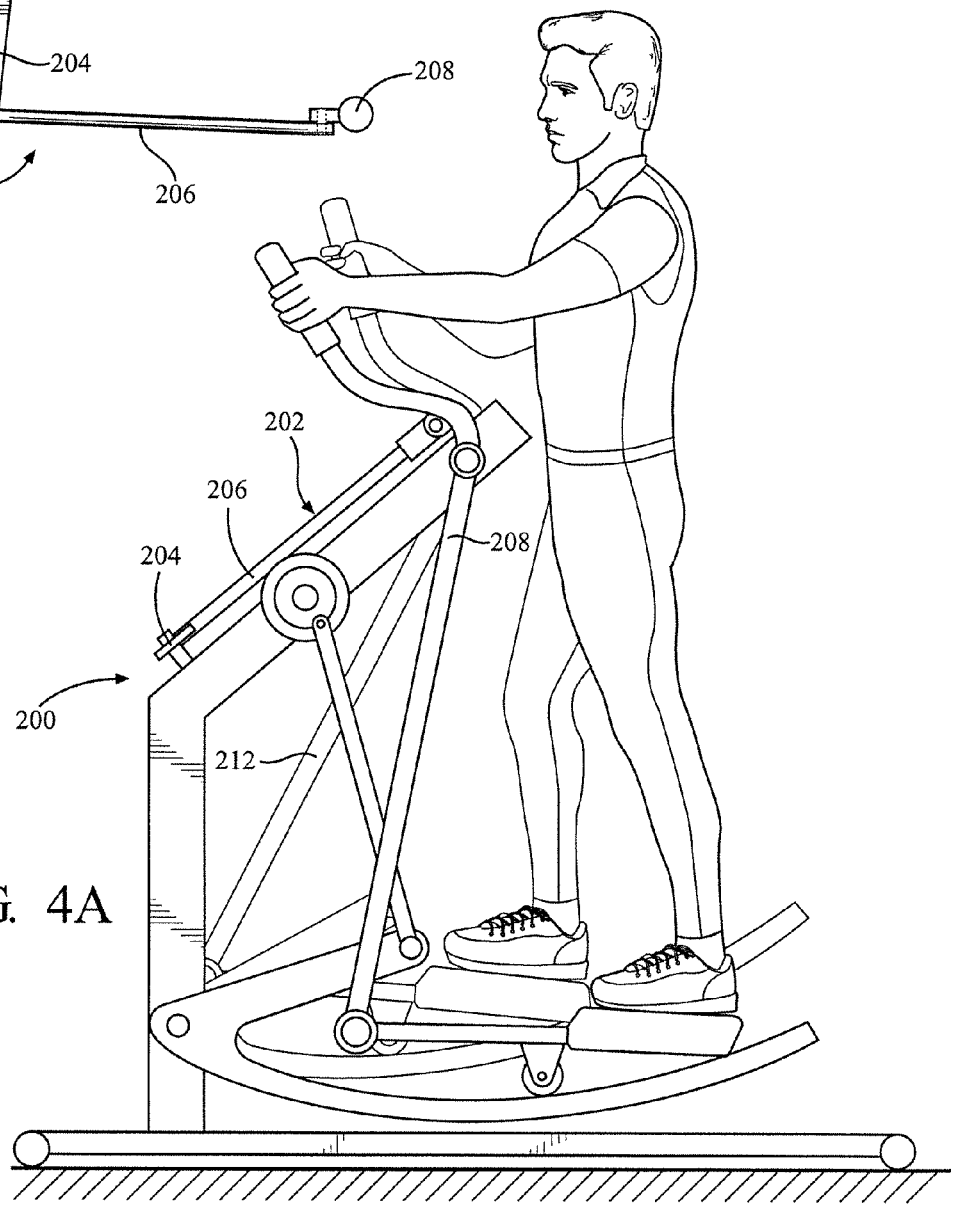
FIG. 4A is a side elevation view of a free stride version of an elliptical exercise device in accordance with the present invention.

FIG. 4A shows an embodiment of a free stride elliptical exercise device 200. It is similar to the design of FIGS. 1 and 2 but eliminates the horizontal control links. A coordination mechanism 202 may be provided to provide equal and opposite motion of the guide links. FIG. 4B provides a top view of the mechanism 202. A horizontal rocker link 204 has a midportion pivotally connected to the frame. A left horizontal control link 206 interconnects the left guide link 208 with one end of the rocker link 204 and a right horizontal control link 210 interconnects the right guide link 212 with the other end of the rocker link. A second flywheel and resistance assembly 214 may be coupled to or associated with the horizontal coordination mechanism.

Figure 5:
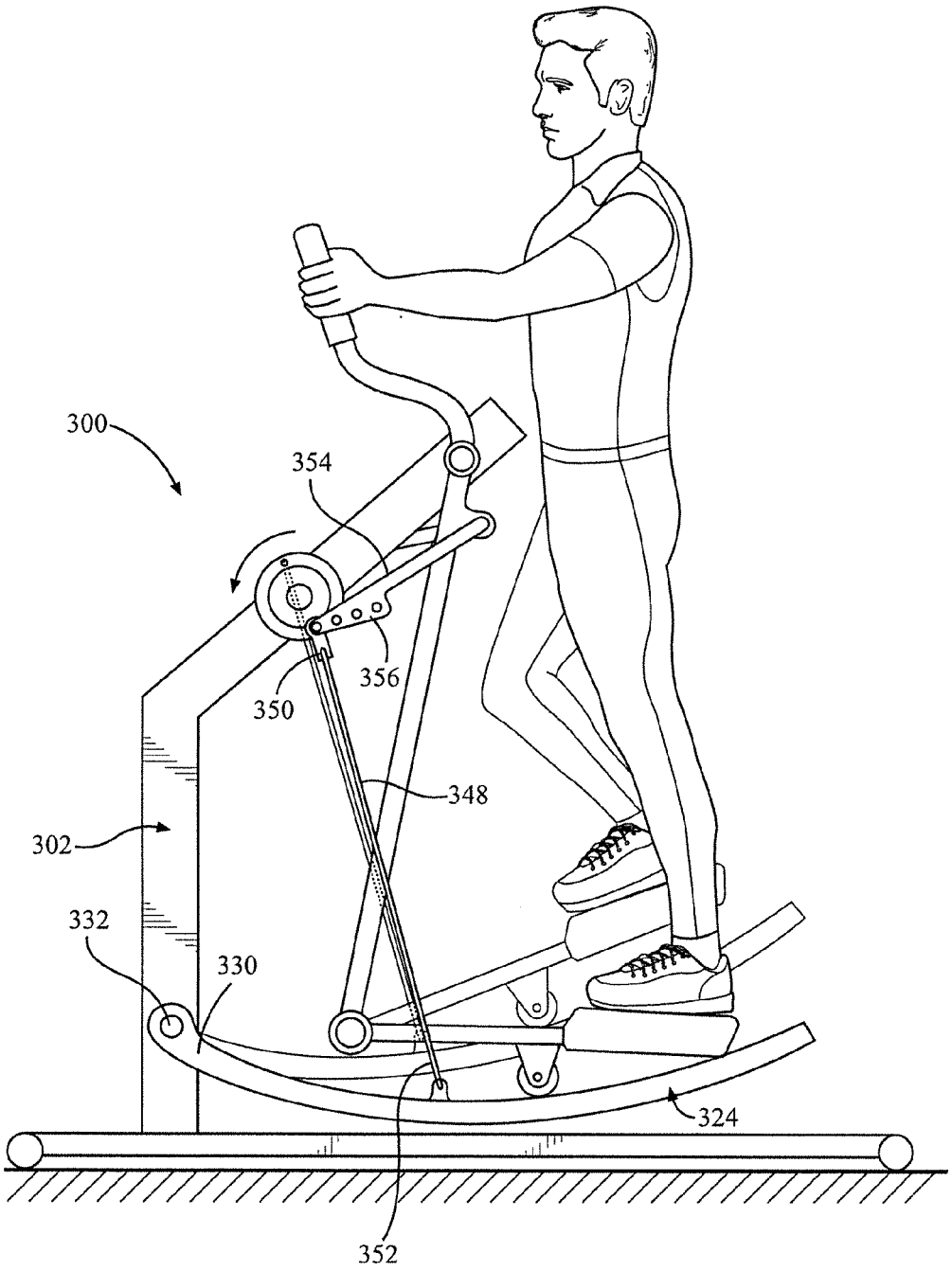
FIG. 5 is a side elevational view of another embodiment of an elliptical exercise device in accordance with the present invention.

FIG. 5 shows an alternative embodiment of an elliptical exercise device 300. Certain components are similar to earlier embodiments, so only differences will be discussed. The device 300 has vertical control tracks that are simpler than in the above-discussed versions. The vertical control track 324 has a forward end 330 that is pivoted to the frame 302 at a second pivot axis 332, but lacks the connection portion of the other versions. The vertical control elements 348 take the form of flexible elements, such as cables, that have lower ends connected to the track 324 midway between its forward and rearward ends. As shown, the attachment locations may be adjustable to adjust the amount of travel. The illustrated adjustment mechanism allows the upper ends 350 of the flexible elements to be attached to the crank or to various attachment points 356 on the respective horizontal control link 354 rather than directly to the crank. The illustrated version is a fixed path device. A free stride version may be provided by eliminating the horizontal control links 354 and adding a horizontal coordination linkage.

Figure 6C:
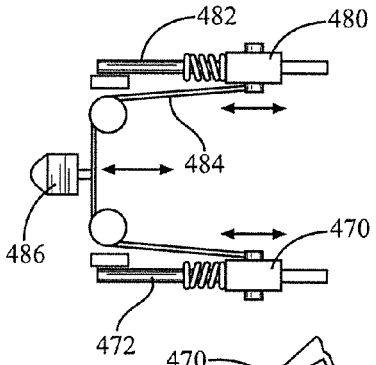
FIG. 6C is a top view of the adjustment mechanism of FIG. 6B.
Figure 6B:
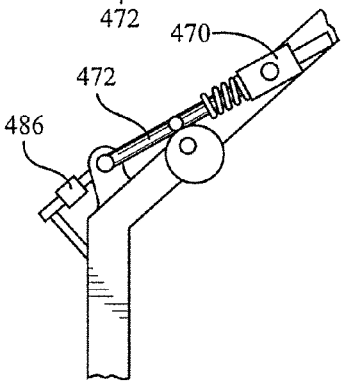
FIG. 6B is a side view of an adjustment mechanism for use with an exercise device such as the embodiment of FIG. 6A.
Figure 6A:
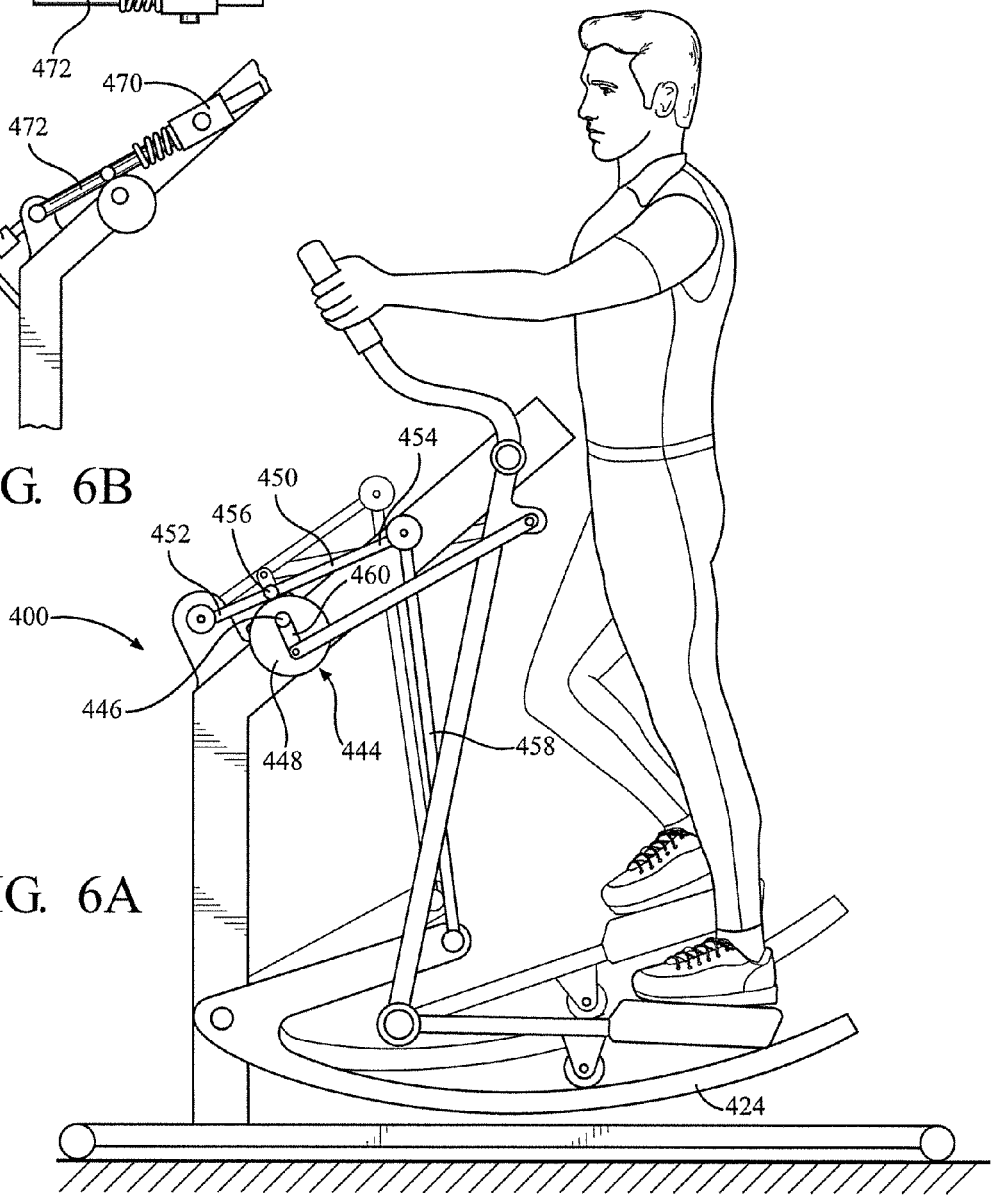
FIG. 6A is a side elevational view of a further embodiment of an elliptical exercise

FIG. 6A shows another version of a fixed path elliptical exercise device 400. The above-discussed versions used a crank system as a drive for the vertical and/or horizontal motion. More generically, a system for driving the vertical and/or horizontal motion may be referred to as a vertical and/or horizontal drive. In the embodiment of FIG. 6A, the vertical drive takes the form of a cam drive 444 that rotates about a cam axis 446. The cam drive 444 includes a first cam 448 and a second cam (not shown, for the other side). In this embodiment, the cams are circular with the center of each cam offset from the axis 446. Other cam shapes may be used. A first pivoting arm 450 has a pivot end 452, at the forward end, and a control end 454, at the rearward end. A cam follower 456, in the form of a roller, is connected to the middle of the pivoting arm 450 and engages the outer surface of the cam 448. As such, as the cam 448 rotates about the axis 446, the control end 454 of the pivoting arm 450 will reciprocate upwardly and downwardly. A vertical control element or link 458 links the control end 454 of the pivoting arm 450 to the vertical control track 424. In some versions, the follower 456 may be omitted with the side of the pivoting arm engaging the cam.

A crank 460 is provided for controlling horizontal motion. The crank has the same axis of rotation 446 as the cam drive.

Alternatively, a separate crank and cam drive may be provided, and may be interconnected for coordinated rotation.

FIGS. 6B and 6C shows one version of an adjustment mechanism for adjusting the amount of vertical travel. A sliding collar 470 is provided on the left pivoting arm 472 and a sliding color 480 is provided on the right pivoting arm 482. The collars define the control end of each pivoting arm and the vertical control links would connect thereto. The collars are biased away from the pivot ends by springs. A cable 484 connects both collars to an actuator 486 for adjusting the position of the collars.

Figure 7B:
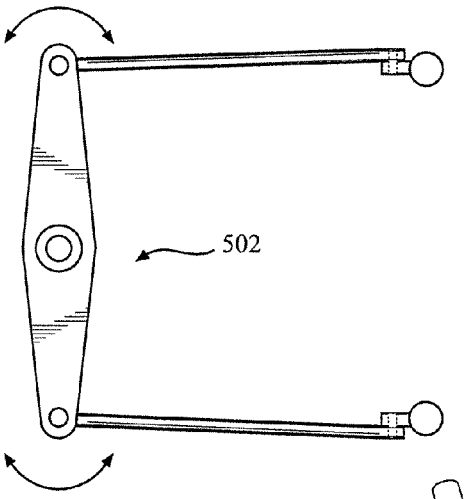
FIG. 7B is a top view of the horizontal coordination mechanism used on the exercise device of FIG. 7A.
Figure 7A:
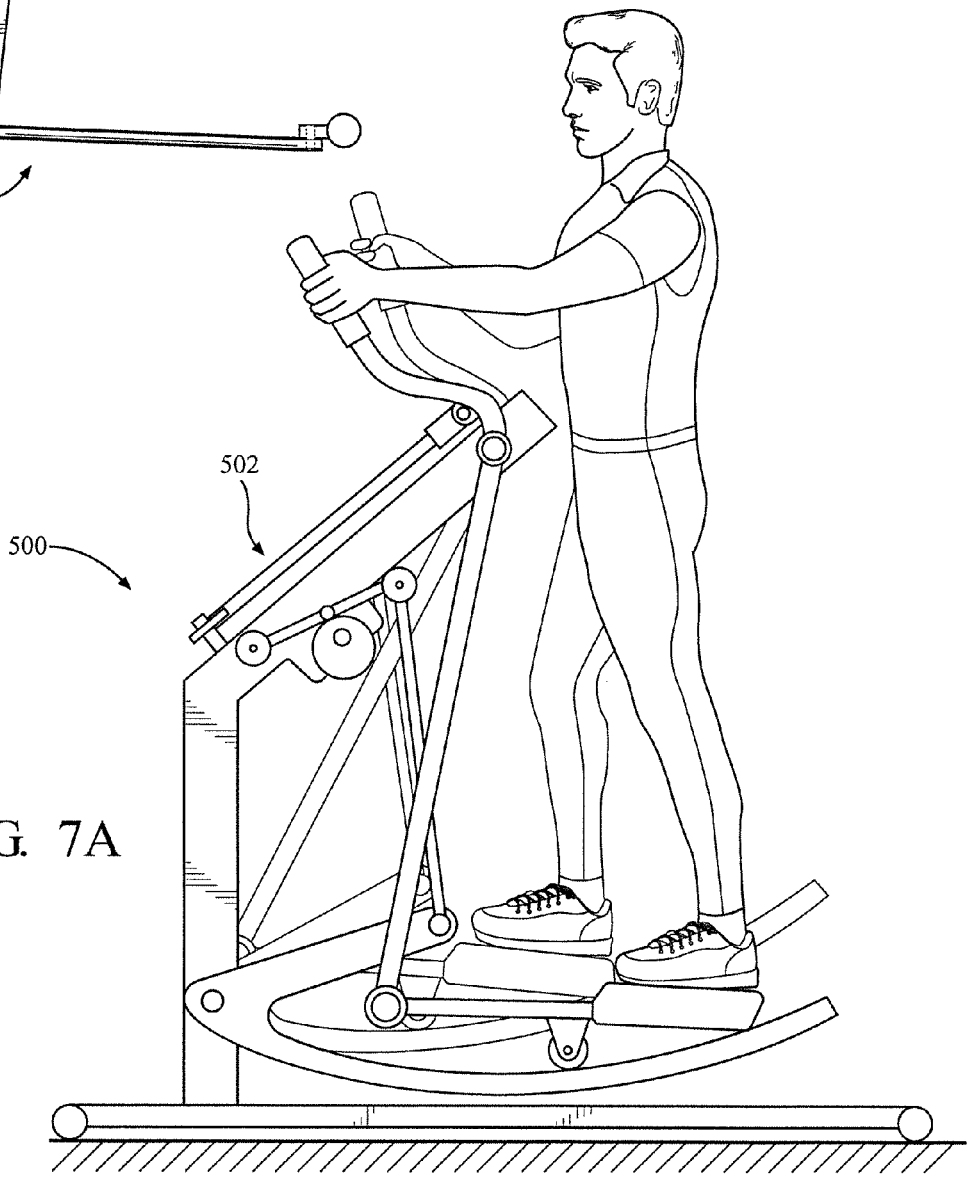
FIG. 7A is a side elevational view of yet another embodiment of an exercise device according to the present invention.

FIG. 7A shows a free stride version 500 of the exercise device 400. The horizontal control links have been eliminated and a horizontal coordination linkage 502 is provided. FIG. 7B shows a top view of the horizontal coordination linkage 502.

It is noted that certain adjustment approaches are illustrated for certain embodiments. The adjustment mechanisms may be applied to any embodiment and aspects of the various adjustment mechanisms may be combined with one another As will be clear to those of skill in the art, the embodiments of the present invention illustrated and discussed herein may be altered in various ways without departing from the scope or teaching of the present invention. Also, elements and aspects of one embodiment may be combined with elements and aspects of another embodiment. It is the following claims, including all equivalents, which define the scope of the invention.

I claim:

1. An elliptical exercise device comprising:

a frame configured to be supported on a horizontal surface, the frame having a first pivot axis and a second pivot axis defined thereon, the frame further having a forward portion forward of the first pivot axis and a rearward portion rearward of the first pivot axis, the second pivot axis being on the forward portion of the frame;

a first and a second vertical control track each having a track surface, each vertical control track having a forward end pivotally connected to the second pivot axis of the frame and a coupling point defined rearward of the second pivot axis;

a first and a second guide link each having a first and a second attachment point defined thereon, each guide link being pivotally attached, through its first attachment point, to the frame at the first pivot axis thereof;

a first and a second foot support link each having a foot receiving area configured to support a user's foot thereupon, each foot support link being pivotally connected to the second attachment point of a respective one of the guide links so that when the guide links pivot relative to the frame, they each cause the respective foot receiving area to move in a path of travel having a horizontal component of motion;

each foot support link engaging the track surface of a respective one of the vertical control tracks and being vertically supported thereby;

a vertical drive coupled to the forward portion of the frame; and a first and a second vertical control element each having an upper end coupled to the vertical drive and a lower end coupled to the coupling point of the respective vertical control track such that the vertical drive causes the vertical control tracks to pivot with respect to the frame and the foot receiving area of the respective foot support link to move in a path having a vertical component of motion;

a horizontal drive; and a first and a second horizontal control link each having a first end connected to the horizontal drive and a second end connected to a respective one of the guide links such that the horizontal drive causes the guide links to pivot about the first pivot axis, thereby moving the foot receiving areas of the foot support links in a path of travel having a horizontal component of motion, movement of each foot receiving area in the path of travel having a horizontal component of motion being generally out of phase with the movement in the path of travel having a vertical component of motion such that when the horizontal component of motion of each foot receiving area is at its forwardmost or rearwardmost limit, the vertical component of motion of the same foot receiving area is approximately midway between its uppermost and lowermost limit;

whereby the foot receiving area of each foot support link moves in a generally elliptical path.

2. An elliptical exercise device in accordance with claim 1, wherein the vertical drive and the horizontal drive jointly comprise a crank, the crank having a first and a second attachment point spaced from the crank axis, the upper ends of the vertical control elements being connected to a respective one of the attachment points.

3. An elliptical exercise device in accordance with claim 1, wherein the vertical drive comprises a cam drive having a first and second cam supported for rotation about an axis of rotation and a first and a second pivoting arm engaging the respective first and second cams such that rotation of the cams causes movement of the pivoting arms, the upper ends of the vertical control elements each being connected to a respective one of the pivoting arms.

4. An elliptical exercise device in accordance with claim 3, wherein the horizontal drive is a crank and the cam drive and the crank are supported for rotation about the same axis of rotation.

5. An elliptical exercise device in accordance with claim 3, wherein each pivoting arm has a cam follower, the cam follower engaging the respective cam.

6. An elliptical exercise device in accordance with claim 1, wherein the track surface of each vertical control track is an upper surface of the vertical control track, the upper surface being concave.

7. An elliptical exercise device in accordance with claim 1, wherein each foot support link is a rigid member and the foot receiving area is fixed with respect to a remainder of each respective foot support link.

8. An elliptical exercise device in accordance with claim 7, wherein each foot support link has a forward end that is pivoted to the second attachment point of the respective guide link and a rearward end defining the foot receiving area.

9. An elliptical exercise device in accordance with claim 8, wherein each foot support link has a roller, the roller engaging the track surface.

10. An elliptical exercise device in accordance with claim 9, wherein each roller is disposed on a rearward portion of the respective foot support link.

11. An elliptical exercise device in accordance with claim 10, wherein each foot receiving area is defined behind the respective roller.

12. An elliptical exercise device in accordance with claim 1, wherein each vertical control track is supported only by the respective pivotal connection to the second pivot axis of the frame and the respective vertical control element.

13. An elliptical exercise device in accordance with claim 1, wherein the forward end of each vertical control track further has a connection portion extending reawardly from the pivotal connection and above an upper surface of the track, the lower end of each vertical control element being connected to a rear end of the connection portion of the respective vertical control track.

14. An elliptical exercise device in accordance with claim 1, wherein each vertical control element is a flexible element.

15. An elliptical exercise device in accordance with claim 1, wherein each vertical control element is a rigid link.

16. An elliptical exercise device in accordance with claim 1, wherein each guide link further has a hand grip that extends upwardly from the respective first attachment point.

17. An elliptical exercise device in accordance with claim 1, wherein the horizontal control links are each adjustably connected to the crank or the respective guide link so as to adjust the range of horizontal motion.

18. An elliptical exercise device in accordance with claim 1, further comprising an adjustment mechanism for adjusting a range of vertical travel.

19. An elliptical exercise device in accordance with claim 1, further comprising a flywheel and resistance assembly coupled to the vertical drive and crank.

20. An elliptical exercise device in accordance with claim 1, wherein the upper end of each vertical control elements is coupled to the vertical drive by being connected to the respective one of the horizontal control links.

21. An elliptical exercise device in accordance with claim 20, wherein the connection between the upper end of each vertical control element and the respective horizontal control link is adjustable so as to adjust a range of vertical travel.

* * * * *